US005282251A

United States Patent [19]

Petersen

[11] Patent Number: 5,282,251

[45] Date of Patent: Jan. 25, 1994

[54] SPEAKER DEVICE FOR THE HEARING IMPAIRED

[76] Inventor: Jack N. Petersen, 103 Lake Sears Dr., Winter Haven, Fla. 33880

[21] Appl. No.: 923,829

[22] Filed: Aug. 3, 1992

[51] Int. Cl.[5] ..... H04R 25/00

[52] U.S. Cl. ..... 381/24; 381/188; 381/205

[58] Field of Search ..... 381/24, 188, 205; 181/199, 211; 84/376 A; 248/163.1, 176

[56] References Cited

U.S. PATENT DOCUMENTS

| | | | |
|---|---|---|---|
| 3,810,525 | 5/1974 | Crenna | 181/23 |
| 3,870,834 | 3/1975 | Yeaple | 381/24 |
| 3,976,162 | 8/1976 | Cummings | 381/24 |
| 4,545,276 | 10/1985 | Curletto | 84/376 A |
| 4,831,656 | 5/1989 | Southern et al. | 381/169 |

FOREIGN PATENT DOCUMENTS

| | | | |
|---|---|---|---|
| 0074396 | 4/1988 | Japan | 381/188 |
| 4-017500 | 1/1992 | Japan | 381/24 |

*Primary Examiner*—Jin F. Ng
*Assistant Examiner*—Huyen D. Le

[57] ABSTRACT

A portable speaker system for the hearing impaired, comprising at least two speakers mounted on a framework which can be moved easily around a room, and specifically moved to allow one speaker to be directed at the left ear, and the other speaker directed to the right ear. As the speakers are adjustable in their direction, and volume, a person with impaired hearing can position the speakers at the side of their chair, adjust the volume as required, and hear the audio sound at their level of volume, while persons with normal hearing are allowed to hear the same audio sound at normal levels. In another embodiment of this invention, each speaker can be connected to a separate sound source, to produce a stereo effect.

2 Claims, 2 Drawing Sheets

SPEAKER DEVICE FOR THE HEARING IMPAIRED

BACKGROUND OF INVENTION

This invention relates to an apparatus and method of aiding the hearing impaired to listen to Television, or, Music, in the same room with other persons having normal hearing, without requiring the sound to be turned up to a higher level, in order to hear the sounds.

It has been customary for the hearing impaired to be seated closer to the source of the audio sound than persons with normal hearing, or, to have the audio sound turned to a higher level than ordinary, in order for the hearing impaired to enjoy the same sounds as the persons with the normal hearing. This situation causes much frustration to either the hearing impaired, or the persons with normal hearing, because, either the hearing impaired cannot hear the sounds, or, the persons with normal hearing are required to listen to the audio sounds at a much higher level than they can enjoy, or, a seating arrangement must be used, which can be a problem in most rooms.

Several approaches have been provided for aiding these persons with impaired hearing. Chairs have been designed with speakers implanted in the backs of the chairs, and, these devices do aid the hearing impaired, however, the chair assignment in the room must be decided in advance, and, cleaning the room becomes a frustration to the cleaner, due to the required wires on the floor being a nuisance to the vacuum cleaner, sweeper, or general cleaning.

Crenna, in U.S. Pat. No. 3,810,525 teaches a set of head phones, connected to the sound source, to aid the hearing impaired. There is a definite problem with these devices, in that the person with the hearing impaired cannot enter into any other discussions with the persons with normal hearing, due to the fact that the headphones blank out all of the other audio sounds.

Another approach is taught by Southern, in U.S. Pat. No. 4,831,656, wherein a large, complicated audio amplifier is placed in the room with the person with the hearing impairment, and all audio sounds are transmitted to the headphones of any person with the impaired hearing. Obviously, this system would be a nuisance to the normal household, as well as being very expensive.

SUMMARY OF THE INVENTION

Accordingly, it is an object of this invention to provide a method and apparatus for aiding the hearing impaired, which can be located anywhere in the room, and allow the person with the impaired hearing to hear the audio sounds at the required level, and the same audio sounds being heard by the persons having normal hearing in the same room, at their normal level.

Another object of this invention is to provide the apparatus in a lightweight, mobile design, allowing it to be moved to a storage location, as desired, when the apparatus is not in use, and thereby allowing the cleaning to be accomplished without becoming entangled in the audio wires.

Another object of this invention is to provide this apparatus in a very presentable decor design, fitting in with the other furniture in the room.

Still another object of this invention is to provide for the connection of individual audio wires to individual speakers in the system, allowing for the projection of stereophonic, quadraphonic, and other sound effects to the listener.

In carrying out this invention in the illustrative embodiment thereof, two speakers are opposedly mounted on a moveable framework, the framework having two distinct uprights, and a speaker mounted on top of each upright. The two uprights are fitted with a steadying framework on the bottom of each upright, to prevent the two uprights from tipping over, and a cross piece is fitted between the two uprights at their bottommost ends, to keep them at the desired distance apart, for ultimate sound projection to a person sitting in a chair, between the speakers. If the person has impaired hearing, adjustment of the output of the two speakers will amplify the audio sound to a desired level for each ear.

Conveniently, the person with the impaired hearing sits in their chair, the framework is positioned in the desired location with the speakers directly focused into each ear, the volume is set to a desired level for each ear, and the audio wire is plugged into the sound producing device, either a Television, or, a record, or cassette player, or other device and the person with the impaired hearing can enjoy the same program as the other listeners, and, can carry on conversations with the other listeners, not being cut off from the conversations by headphones, or the like.

BRIEF DESCRIPTION OF THE DRAWINGS

This invention, together with other objects, features, aspects and advantages thereof, will be more clearly understood from the following description, considered in conjunction with the accompanying drawings.

Two sheets of drawings are furnished, sheet one contains FIG. 1, and sheet 2 contains FIG. 2, and FIG. 3.

DESCRIPTION OF THE PREFERRED EMBODIMENTS

Figure 1:
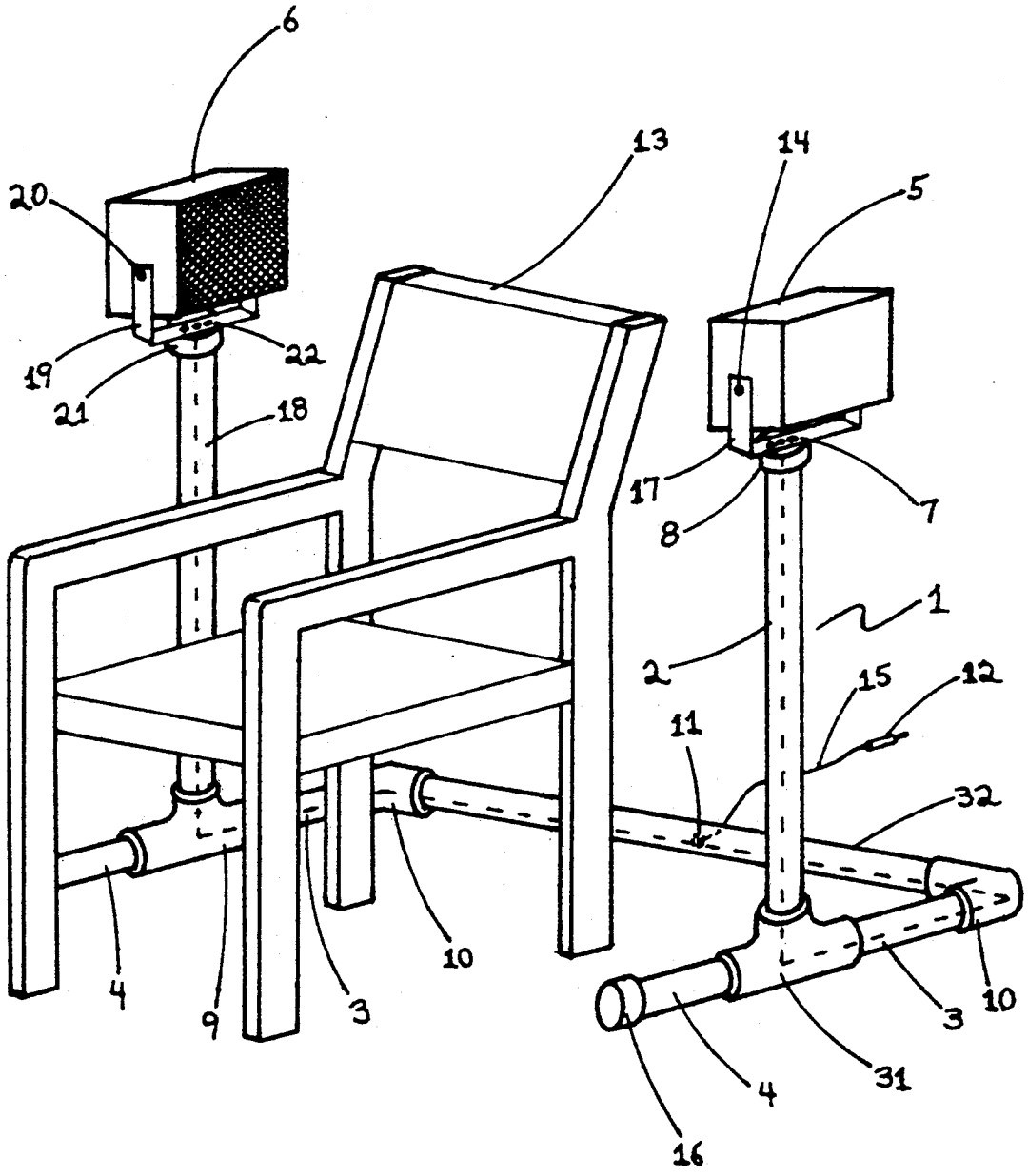
FIG. 1 is an isometric view of the invention positioned around a chair.

Referring now to FIG. 1, a speaker device for the hearing impaired referred to generally by the reference numeral 1, is made of a suitable material to hold, and position two speakers 5, and 6, at a sufficient distance apart for positioning at each side of a chair 13. As seen in FIG. 1, the two speakers 5 and 6, are mounted directly at the top of two uprights 2, and 18, by means of mounting brackets 17, and 19. Now, these two uprights 2, and 18 extend downward, and are permanently inserted into two "T" fittings 9 and 31. Extending from each of the T fittings 9, and 31 are forward extending pieces 4, and each of these forward extending pieces 4 are terminated by cap pieces 16. Also, and still referring to FIG. 1, the two T fittings 9 and 31 each having rearward extending pieces 3, and these rearward pieces 3 each connecting into 90 degree fittings 10, and these 90 degree fittings 10 connecting into a horizontal extending cross piece 32, and all of these pieces 4, 9, 3 and 32 thereby forming a base for the framework 1.

Figure 2:
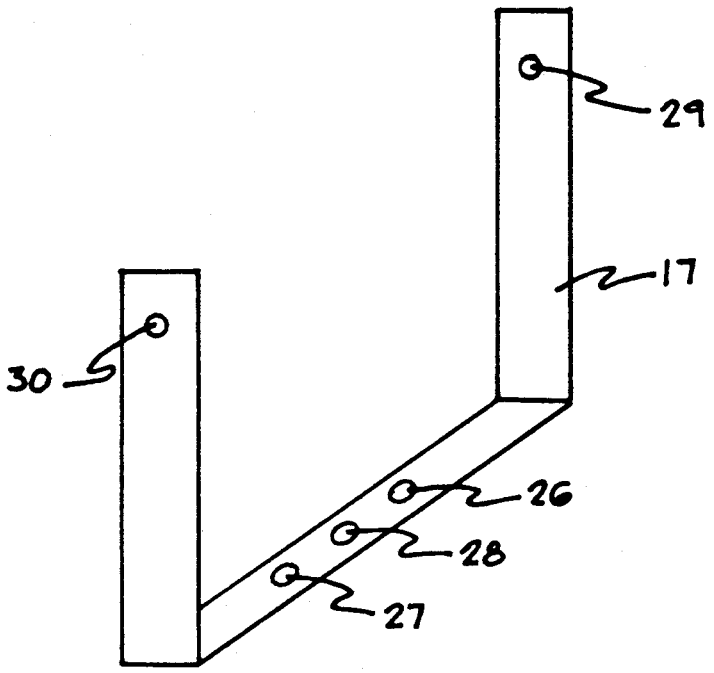
FIG. 2 is an isometric view of the mounting bracket for the speakers.

Now, referring specifically to FIG. 2, we see a preformed, and pre-drilled bracket 17, and this bracket 17 having mounting holes 29, for mounting speakers 5, and a similar bracket 19 mounting speaker 6, on opposite upright 18, more easily seen in FIG. 1. Attaching bolts 14, and 20, forming the holding of speakers 5, and 6 respectively.

Figure 3:
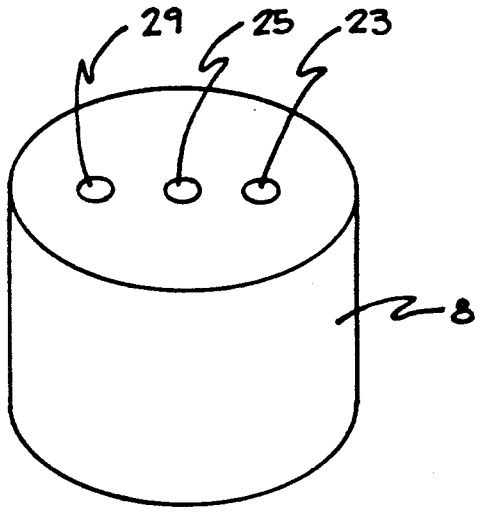
FIG. 3 is an isometric view of the top cap of one of the uprights, showing the mounting holes, and the hole for the audio wires.

Now, and referring specifically to FIG. 3, we see a top cap 8, and this top cap 8 having pre-drilled holes 23, and 29, for mounting bracket 17, and a similar top cap 21 on the opposite upright for mounting bracket 19. Speaker 5 is moveably attached to bracket 17, and speaker 6 is moveably attached to bracket 19.

Returning now to FIG. 1, an audio wire 15 being attached to both speakers 5, and 6 on one end, is threaded downward through uprights 2, and 18, rearward through floor braces 3, inward through horizontal cross piece 32, and exiting through pre-drilled hole 11, leaving sufficient slack in audio wire 15 to reach the audio source, and terminating in a banana type plug 12, for insertion into the audio source.

The person with the impaired hearing now positions themselves in the chair 13, adjusts the position of the two speakers 5, and 6, to produce the desired direction of the audio signal, and the volume, and enjoys the audio at a volume which does not interfere with the persons with normal hearing.

Accordingly, a very unique, attractive, convenient method and apparatus are provided for allowing a hearing impaired person to hear the audio portion of a program, without having to turn up the volume of the audio sound to a level to interfere with the comfort of the other listeners, and these listeners having normal hearing.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A speaker device for the hearing impaired, for allowing a person with impaired hearing to hear the audio portions of a program, at their required level of sound, in the same room with persons having normal hearing, without interfering with the comfort of the persons with normal hearing, comprising:

a portable speaker system, consisting of at least two speakers, each said speaker moveably, and adjustably affixed to the upper end of an upright, said upright being of a height as to direct an audio sound eminating from said speakers directly towards the ear of the listener, a framework, said framework comprising said two uprights, said two uprights being affixed to a T fitting at their bottom ends, and forward, and rearward extensions affixed to said T fittings, and a 90 degree fitting affixed at the rear end of each said rearward extension, and a cross member affixed between said 90 degree fittings on their opposite end opening, and said cross member being of a length to allow said framework to be positioned moveably around the back of a chair, thereby forming a base structure for said two uprights, decorative caps covering all end openings of said framework, an audio wire system comprising audio wires and an audio source, said audio wires being terminated on one end at said speakers, said audio wire then being threaded downward through the framework, and outward through a pre-drilled hole in said cross piece of said framework, and terminating, and affixed at its opposite end to a compatible plug for said audio source.

2. A speaker device of claim 1, whereby separate audio wires are affixed to each said speaker at one end, and affixed to a separate audio signal at the opposite end.

* * * * *